US008333149B2

(12) United States Patent
Melotti et al.

(10) Patent No.: US 8,333,149 B2
(45) Date of Patent: Dec. 18, 2012

(54) DRYING EQUIPMENT WITH FALSE AIR TREATMENT FOR PRINTING MACHINES

(75) Inventors: Renzo Melotti, Sala Monferrato (IT); Marco Olmo, Olcenengo (IT); Giacomo Mario Piero Truffi, Milan (IT)

(73) Assignee: Bobst Group Italia S.p.A. (IT)

( * ) Notice: Subject to any disclaimer, the term of this patent is extended or adjusted under 35 U.S.C. 154(b) by 0 days.

(21) Appl. No.: 12/838,615

(22) Filed: Jul. 19, 2010

(65) Prior Publication Data

US 2011/0017083 A1 Jan. 27, 2011

(30) Foreign Application Priority Data

Jul. 24, 2009 (EP) ..... 09009616

(51) Int. Cl.
*B41F 35/00* (2006.01)

(52) U.S. Cl. ..... 101/424.1; 101/417

(58) Field of Classification Search ..... 101/424.1
See application file for complete search history.

(56) References Cited

U.S. PATENT DOCUMENTS

| | | | | | |
|---|---|---|---|---|---|
| 2,225,505 | A | * | 12/1940 | Offen | 34/465 |
| 4,125,948 | A | * | 11/1978 | Hering et al. | 34/655 |
| 4,150,495 | A | * | 4/1979 | Stern | 34/567 |
| 4,233,901 | A | * | 11/1980 | Mallinson | 101/424.1 |
| 4,442,611 | A | | 4/1984 | Guenther et al. | |
| 4,484,396 | A | * | 11/1984 | Darm | 34/516 |
| 4,581,244 | A | * | 4/1986 | Murphy | 427/475 |
| 4,591,517 | A | | 5/1986 | Whipple et al. | |
| 5,090,898 | A | * | 2/1992 | Smith | 431/326 |
| 5,579,590 | A | * | 12/1996 | Seidl et al. | 34/559 |
| 6,176,184 | B1 | * | 1/2001 | Mudry | 101/424.1 |
| 2003/0019125 | A1 | * | 1/2003 | Hanaya | 34/114 |

FOREIGN PATENT DOCUMENTS

| | | |
|---|---|---|
| DE | 195 05 971 A1 | 8/1996 |
| JP | 59-165658 A | 9/1984 |

OTHER PUBLICATIONS

European Search Report dated Dec. 16, 2009, issued in corresponding European priority application No. EP 09009616.

* cited by examiner

*Primary Examiner* — Anthony Nguyen
(74) *Attorney, Agent, or Firm* — Ostrolenk Faber LLP

(57) ABSTRACT

A ventilation and drying equipment for printing machines, including ovens operable to dry solvent on a printed support travelling through the ovens passages into and out of the ovens through which false or ambient air can enter the oven from the outside. At least one false air suppression device for which each printing unit covers at least one of the passages and which is maintained at a pressure lower than the air pressure inside the oven, to prevent false air from entering the oven through the at least one passage. Each false air suppression device is connected with a common recirculation duct in order to share the false air coming from each printing unit with the whole press.

7 Claims, 8 Drawing Sheets

DRYING EQUIPMENT WITH FALSE AIR TREATMENT FOR PRINTING MACHINES

TECHNICAL FIELD

The present invention relates to a drying equipment and an air recirculation equipment for a printing machine. Printing machines include rotogravure, flexographic and other printing machines designed to print or coat flexible or non-flexible supports, made of aluminium, BOPP (Biaxially Oriented Polypropylene), LDPE (Low Density Polyethylene), paper, board, namely corrugated paper, and other materials.

BACKGROUND ART

Printing presses, especially rotogravure ones, usually comprise a plurality of different printing units or elements, each of which is adapted to print only one color on the support or web. As a consequence, the composition of a colored image needs a sequence of several printing units, one for each color.

The ink or the lacquer used to print is usually diluted with organic solvents such as ethyl acetate, ethyl alcohol and others. Once the ink is printed on the support, the solvent must be removed, e.g. by evaporation, and to this aim the printed support is dried using a hot air flow, generated inside a tunnel or oven through which the printed support is led. The warm air used to dry the solvent on the support may be partly reused in order not to waste too much heat.

The volume concentration of solvent vapors in the air that is reused in the drying process must be kept under strict control, because such vapors can even explode if their concentration (cubic meters of solvent vapor for each cubic meter of air) is between two values known as "Lower Explosion Limit" (L.E.L.) and "Upper Explosion Limit" (U.E.L.).

The amount of air that is reused in the drying process varies for each printing unit depending on the amount of ink and solvent that each printing unit leaves on the web. For instance, a printing unit that prints only few signs in the final image needs a smaller amount of ink than another printing unit that prints, for instance, the background of the image with a high covering of the printing surface. In this way, it is possible to reuse a bigger amount of air and accordingly waste a smaller amount of heat, because even the small amount of air that goes out of the printing unit is sufficient to maintain a low concentration of solvent vapors in the drying tunnel taking away the sufficient amount of solvent.

In many printing presses the amount of air that is reused is fixed during the design and installation of the printing press in order not to exceed 50% of the L.E.L. concentration under any operational condition.

In such presses the recirculation ratio is fixed by the manufacturer in order to guarantee an amount of fresh air coming into the drying oven of each printing unit sufficient to maintain a solvent concentration below 50% of L.E.L. concentration under the worst operational condition.

In real operational conditions, only few printing units of the press work, as said before, with a high ink covering of the web. In the other printing units, working with low ink covering, the drying process takes place with an amount of fresh air higher than necessary, since a very small amount of solvent has to be removed from the web by evaporation. In these printing units the concentration of solvent in the drying air is very low, e.g. 10-15% of L.E.L.

Since it is not established which printing units will provide a high ink covering, the recirculation ratio is based on the highest ink covering that the printing unit can print and equally fixed by the manufacturer for each printing unit.

As a result of the fixed recirculation ratio, to prevent the danger of explosions, in some printing units an amount of fresh air higher than necessary is used. A higher fresh air intake means higher heat necessary for the drying process, larger exhaust air ducts and larger and less efficient exhaust air treatment installations.

It is possible to have more sophisticated measuring systems that can manage the amount of air reused by each printing unit. A system that controls the concentration in more than one point for each printing unit is safer and makes it possible to have the press working by adjusting the recirculation in order to maintain a solvent concentration up to 50% of the L.E.L. concentration even with small quantities of solvent to be evaporated from the web.

With a recirculation ratio adjustment it is possible to set different recirculation ratios on different printing units. As a result, a smaller amount of fresh air is necessary in the drying process of the printing units working with low ink covering meaning lower exhaust air flow from the whole press, and lower heat necessary for the drying process.

The main difference with the fixed recirculation is that for each printing unit is required only the necessary fresh air depending on the real amount of solvent that must be removed from the web in that printing unit.

It is known that the installation constituting the printing machine is not closed, because the printed support needs to travel through the drying tunnel, which must be kept in a depressurized condition in order to prevent the air containing solvent inside the drying tunnel from exiting toward the ambient.

The depressurized condition also causes an amount of ambient air to penetrate into the drying tunnel, at those locations where the printed support enters or exits from the drying tunnel. This air, known as "false air", dilutes the air inside the drying tunnel and must be extracted out of the drying tunnel for maintaining it at a negative pressure with respect to the ambient.

DISCLOSURE OF INVENTION

Aim of the present invention is to minimize or even prevent the intake of false air inside the drying tunnel.

Within the above aim, an object of the invention is to find a way to reuse the false air inside the whole rotogravure machine especially in printing units drying large amount of solvent with low recirculation and using a large amount of fresh air.

Another object is to allow the printing units to work with higher concentration of solvent in the air.

Yet another object of the invention is the minimization of the amount of the exhausted air in order to reduce size and costs of an emission treatment installation in the case of solvent recovery rather than solvent burning.

Not the least object is to provide a whole assembly which is further competitive from a merely economical standpoint.

This aim, these objects and other objects which will become better apparent hereinafter are achieved by a drying equipment for printing machines comprising an oven suitable to dry solvent on a printed support travelling therethrough. The oven comprises passages where false air can enter the oven from the outside. The printing unit comprises at least one false air suppression device which covers at least one of said passages and which is maintained at a pressure lower than the air pressure inside said oven, so as to prevent said false air from entering said oven through said at least one passage.

Because of possible use of water based inks in some printing units and/or the need to take fresh air from outside the working area, a separate duct for fresh air and a by-pass device may be further provided and supplied as an optional equipment.

If different solvents are used on some printing units, a bypass equipment on the exhaust air duct may be also provided.

Further characteristics and advantages of the present invention will become better apparent from the following description of particular embodiments thereof, illustrated only by way of non-limitative examples in the accompanying drawings.

BRIEF DESCRIPTION OF FIGURES IN THE DRAWINGS

FIG. 1*a* shows a single oven printing unit without fresh air and exhausted air bypass;

FIG. 1*b* shows a double oven printing unit without fresh air and exhausted air bypass;

FIG. 1*c* shows a double oven printing unit with a common oven outlet chamber without fresh air and exhausted air bypass;

Figure 6A:
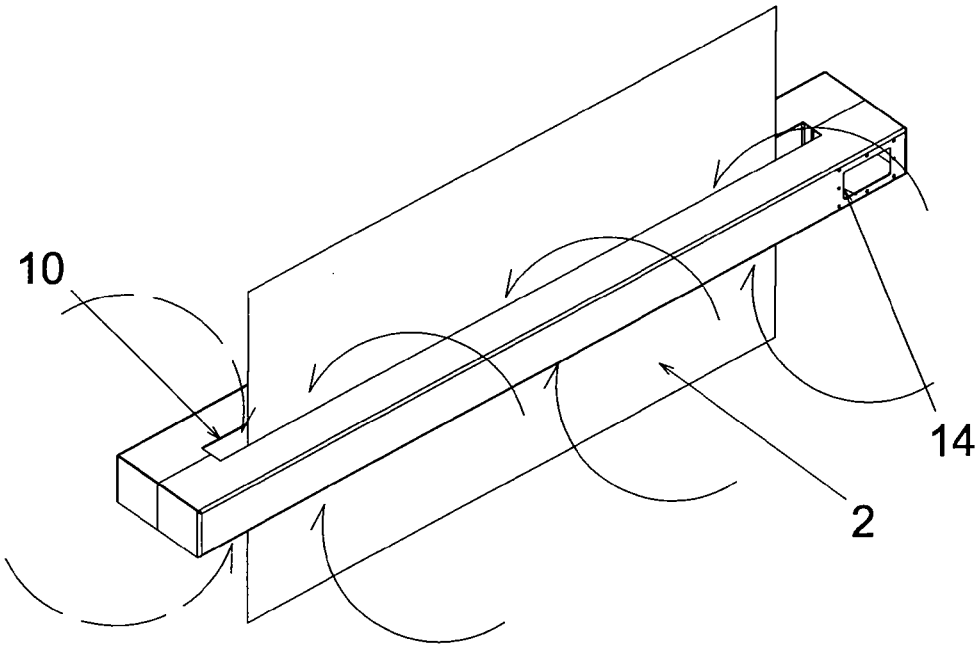
Figure 6B:
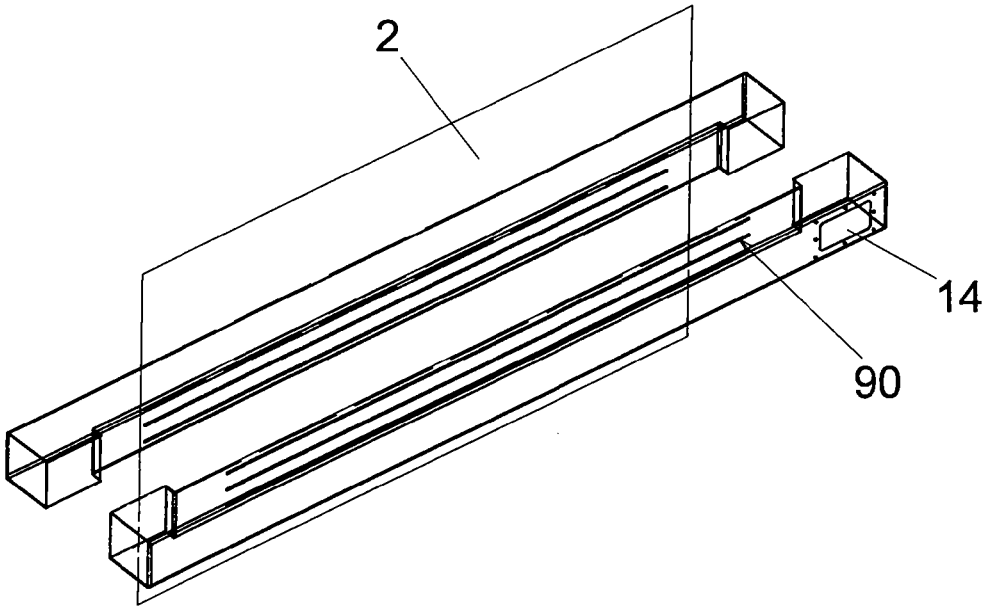

FIGS. 6*a* and 6*b* shows isometric views of the false air suppression device details.

BEST MODE FOR CARRYING OUT THE INVENTION

Figure 1A:
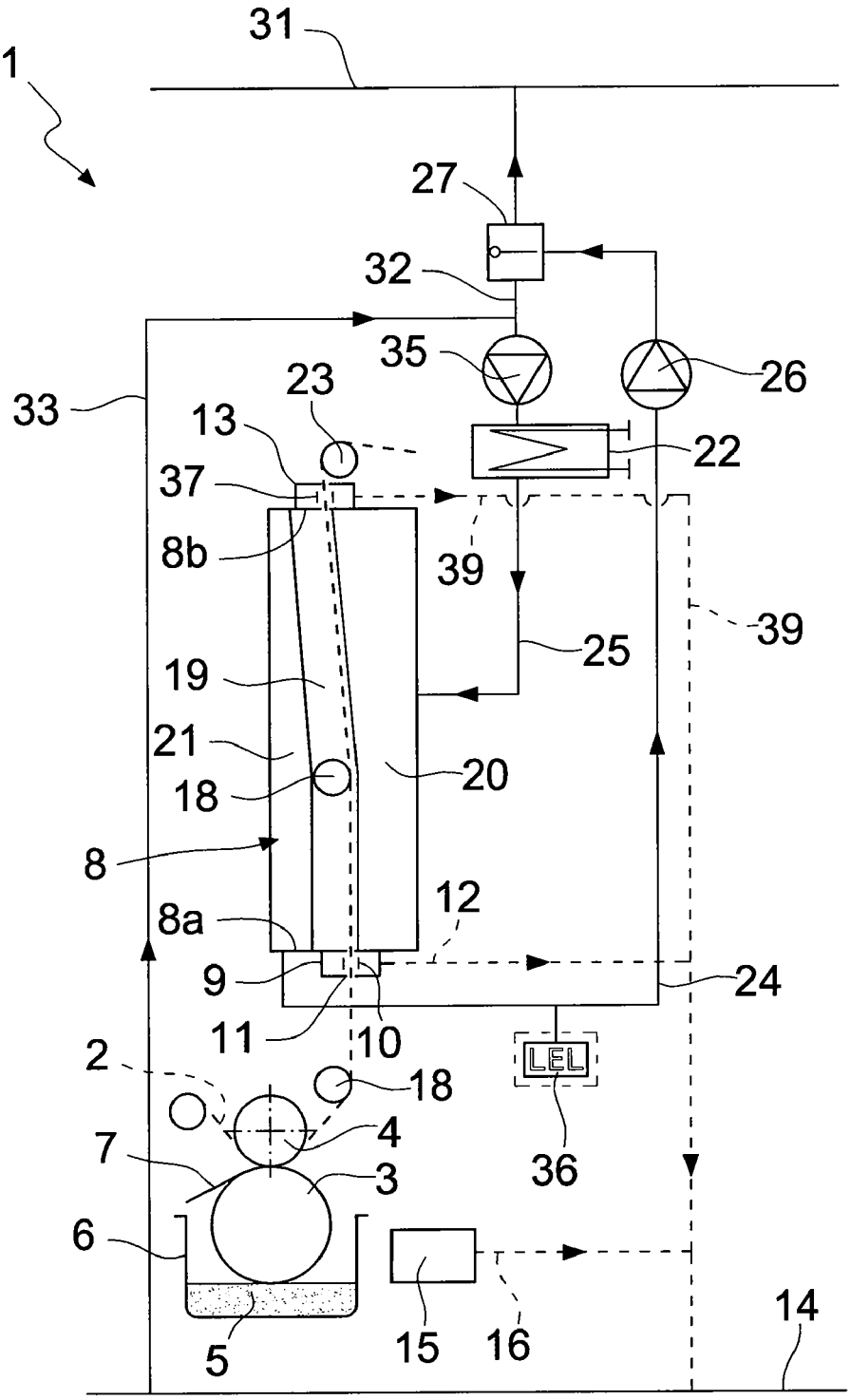

The structure of a single oven printing unit 1 is shown in FIG. 1*a*. As in the conventional rotogravure printing machines, the unit 1 comprises a print roller 3 and an impression roller 4, for printing an image on a support, such as a web 2, by transferring an ink 5 contained in a tank 6 to the print roller 3. A doctor blade 7 is also provided for removing the excess ink from the surface of the print roller 3.

The unit 1 also comprises a drying oven 8, which is provided with a drying chamber 19 which extends between passages comprising an inlet 8*a* and an outlet 8*b* through which the web 2 is led for drying the solvents of the ink on its printed surface. Along the drying chamber 19 and at one or both sides of the web 2 nozzles (not shown) are provided, for blowing hot air towards the printed web 2 during its travel from the inlet 8*a* to the outlet 8*b*. In the exemplary embodiment of FIG. 1*a*, a drying air supply chamber 20 and a drying air exhaust chamber 21 are provided for blowing and collecting such hot air.

The hot air is supplied to the drying air supply chamber 20 through a drying air supply duct 25 by a drying air supply fan 35 connected to a heat exchanger 22. The temperature of the hot air is controlled by regulating the flow of diathermic oil, steam or other heating fluid through the heat exchanger 22 according to the image that is printed in each printing unit, the material of the web 2 and the speed of the press.

A cooled roller 23 may be additionally provided downstream of the drying chamber 19 for preventing the support 2 from being damaged by the drying that takes place in the next printing unit.

A drying air exhaust duct 24 and a corresponding exhaust fan 26 are in communication with the drying air exhaust chamber 21 for removing the air inside the drying chamber 19, which contains solvent vapors. Such air is led by the exhaust fan 26 to a recirculation device 27 that works as a switch and is operated by a control system (not shown) which measures the solvent concentration in the exhaust air. In particular, when the solvent concentration in the exhaust air from the oven 8 is over a certain limit, the recirculation device 27 is adjusted to supply more air into a main exhaust duct 31; otherwise, more exhaust air is sent to the fan 35, in order to be recirculated as drying air.

According to the preferred embodiments of the invention, a false air suppression device is provided at least one of those passages of the drying oven openings 8*a* and 8*b* where false air can enter, in order to define a depressurized chamber upstream of such passages. The pressure inside the false air suppression device is preferably a negative pressure with respect to the ambient, and in any case is lower than the pressure inside the oven.

More specifically, a first false air suppression device 9 is arranged at the inlet 8*a* of the drying chamber 19, so that the web 2 must travel through such device 9 before entering the drying chamber 19. A second false air suppression device may be arranged at the outlet 8*b* of the drying oven 8.

Figure 5:
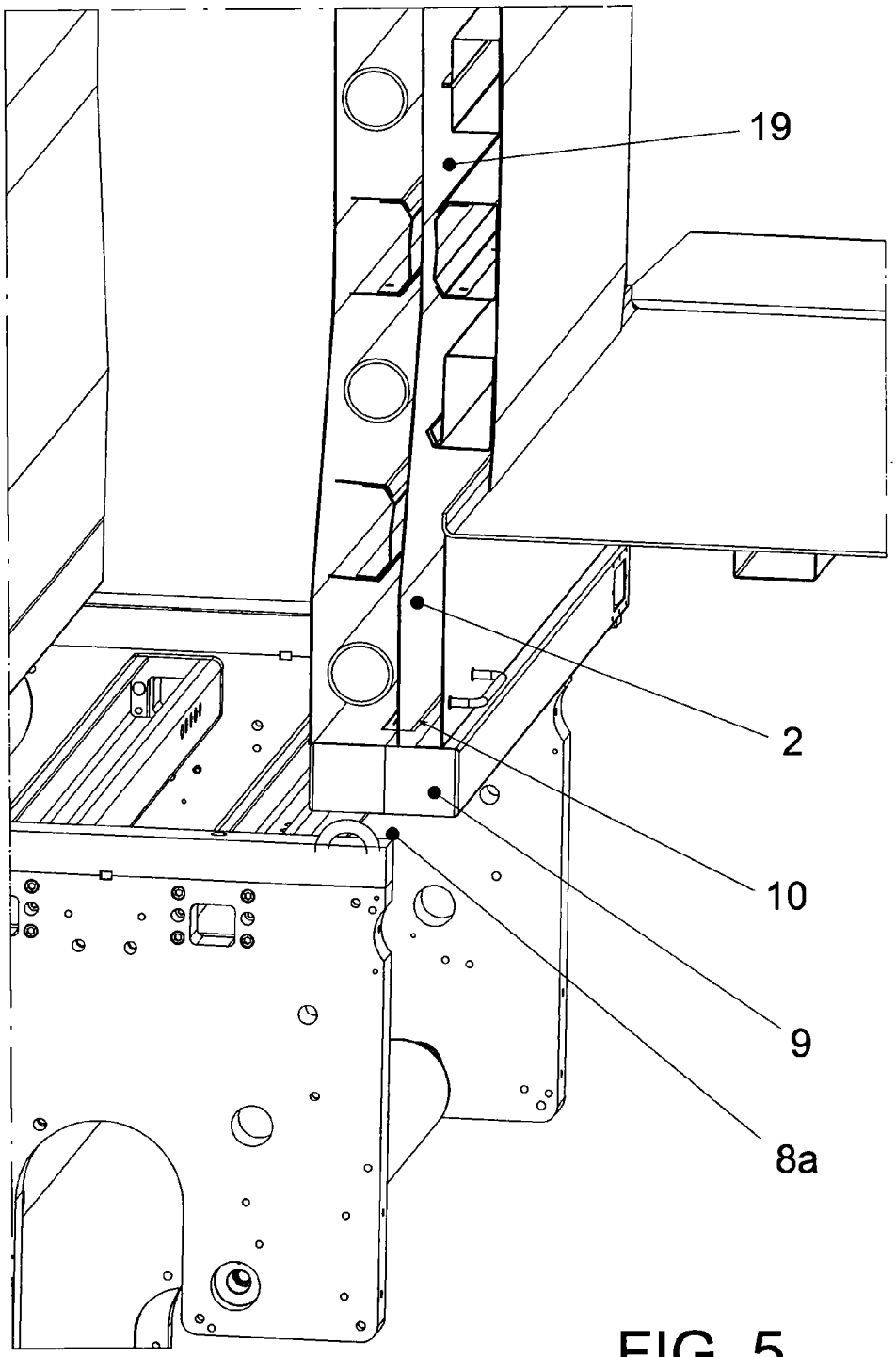
FIG. 5 shows an isometric view of an application of the false air suppression device.

As shown in FIG. 5, according to the layout in FIG. 1*a*, the false air suppression device 9 may be a box-like structure arranged so as to completely cover the inlet 8*a* and the outlet 8*b* of the drying chamber 19 and having a through channel 10 for allowing the web 2 to enter the device 9 and be fed to the inlet 8*a* of the drying chamber 19. As shown in FIGS. 6*a* and 6*b*, the through channel 10 preferably has a plurality of slits 90 on its surface, in order to define a passage for the false air and for connecting the through channel 10 with a first false air exhaust duct 12, by means of which the false air is drawn off the channel 10 and fed to a common recirculation duct 14.

The common recirculation duct 14 is a single duct which is shared by all of the printing units constituting the rotogravure printing machine and which can be used by any printing unit for supplying fresh air to its drying oven 8, for diluting the solvent vapors inside the drying chamber 19, if needed. In particular, the false air suppression devices of each printing unit are connected to the common recirculation duct 14 through their respective false air exhaust ducts, as described herein above. The negative pressure inside the common recirculation duct 14 is maintained by the printing units with the highest demand of fresh air to be injected into their drying ovens.

Each printing unit has an air intake channel 33 which connects the common recirculation duct 14 to the duct 32 between the fan 35 and the recirculation device 27: in this way false air can be heated and recirculated inside the drying oven 8 depending on the particular fresh air requirements of each printing unit 1.

Optionally, a detector 36 is connected to the drying air exhaust duct 24 to measure the concentration of solvent in the air exhausted from the drying oven 8. Using the information obtained by this system, it is possible to adjust the recirculation device 27.

In the preferred embodiment of FIG. 1*a* a second false air suppression device 13 is arranged at the outlet 8*b* of the drying chamber 19. Such device has the same structural and functional features of the first false air suppression device 9 shown in FIGS. 5 and 6*a* and 6*b*, namely it includes a through channel 37 which is maintained depressurized through a second false air exhaust duct 39 in order to avoid that the air with high solvent concentration escapes from the oven 8 toward the ambient and to redirect the false air that comes from the ambient into the drying chamber 19 to the common recirculation duct 14 through the second false air exhaust duct 39.

It is noted that, by means of the false air suppression devices 9 and 13 and the common recirculation duct 14, there is no longer a need to maintain the drying oven 8 at a negative pressure, because the false air suppression devices are already maintained at such a negative pressure through their connection to the common recirculation duct 14.

An air inlet 15 may be additionally present in the printing unit 1 in order to take solvent vapors away from the floor where they tend to accumulate. The air containing such vapors, called "floor sweep air", is also delivered into the common recirculation duct 14 by means of a floor sweep air duct 16.

Figure 1B:
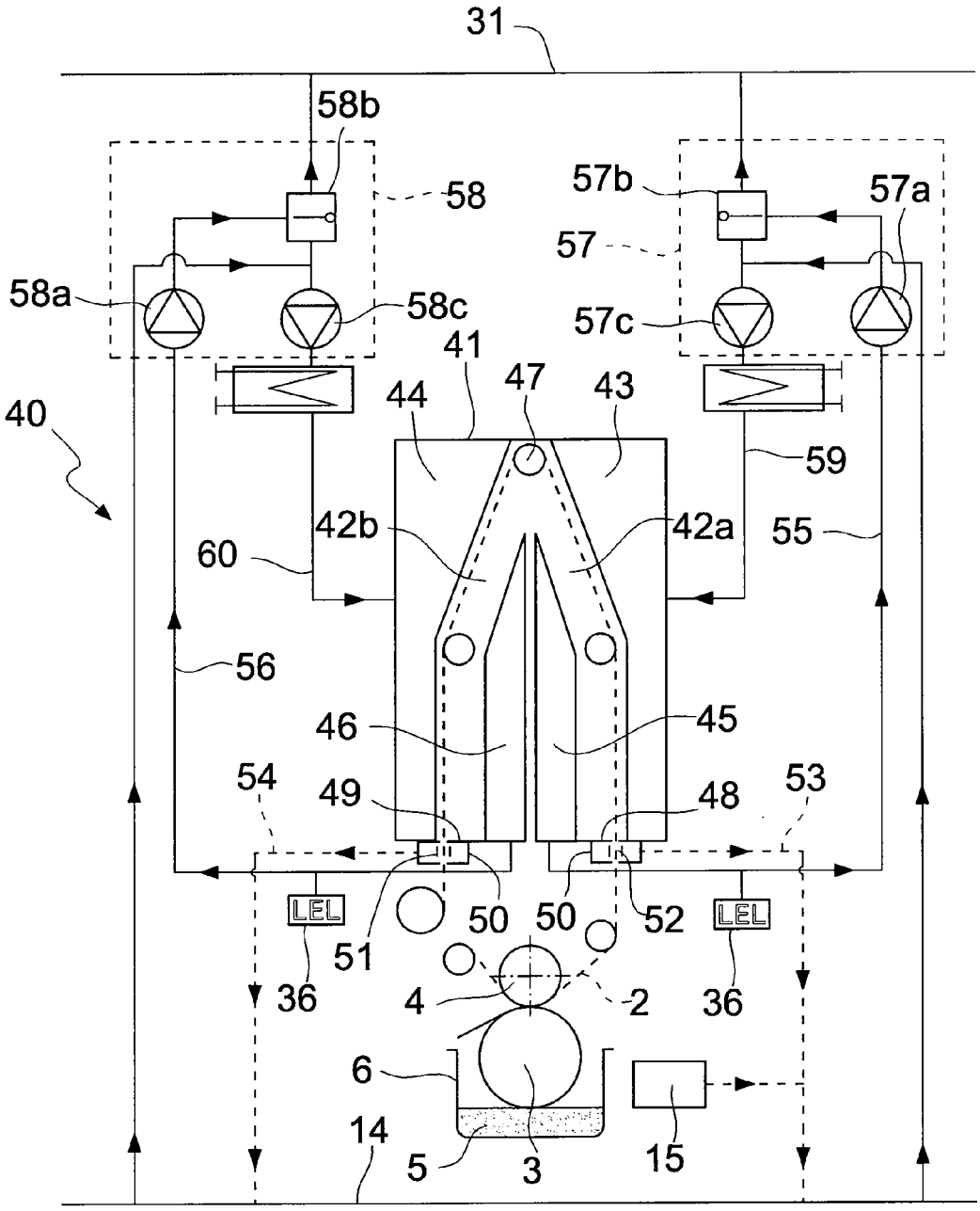

In FIG. 1*b* a printing unit 40 according to a second embodiment of the invention is shown. In this embodiment the printing unit has a double oven 41, which is made of two consecutive drying chambers 42*a* and 42*b* similar to the drying chamber 19 of FIG. 1. The printing unit 40 has all the features of printing unit 1, the only difference being that the number of channels and ducts are doubled because of the structure of the oven. The drying oven 41, in particular, includes a first drying air supply chamber 43, a second drying air supply chamber 44, a first drying air exhaust chamber 45, and a second drying air exhaust chamber 46. The drying air supply chambers 43 and 44 are in front of each other, for blowing drying air to the web 2 travelling in the drying chambers 42*a* and 42*b*, and in their upper part they are separated by a roller 47, which allows the printed support 2 to pass from the first drying chamber 42*a* to the second drying chamber 42*b*.

The web 2, which may be fed to the printing unit 40 by another printing unit of the same rotogravure machine, such as the printing unit 1 described above, is printed by any conventional means, such as a printing roller 3 and an impression roller 4 of the same kind used in the printing unit 1. After being printed, the web 2 enters the drying oven 41 through a first passage comprising an inlet 48 and exits the oven through a second passage comprising an outlet 49. Two false air suppression devices 50 of the kind described above are arranged at both the inlet 48 and the outlet 49, respectively. Each false air suppression device 50 comprises a respective through channel 52 and 51, which are in communication with respective false air exhaust ducts 53 and 54, for maintaining the through channels 52 and 51 at a negative pressure by means of a connection between such ducts 53 and 54 and the common recirculation duct 14.

Each drying air exhaust chamber 45 and 46 includes a respective drying air exhaust duct 55 and 56, as the one described in FIG. 1, which may have its own detector 36 to measure the solvent concentration in the air exhausted from the drying oven 41.

Two separate recirculation systems 57 and 58 are provided, each having a respective exhaust fan 57*a* and 58*a*, a respective recirculation device 57*b* and 58*b* and a respective drying air supply fan 57*c* and 58*c*, having the same aim and function of the exhaust fan 26, the recirculation device 27 and the drying air supply fan 35 described above. From the recirculation systems 57 and 58, air is supplied to the respective drying air supply chambers 43 and 44 through respective drying air supply ducts 59 and 60 and heat exchangers. As in printing unit 1, false air can be recirculated from the common recirculation duct 14 to the drying oven via the recirculation systems 57 and 58.

Figure 1C:
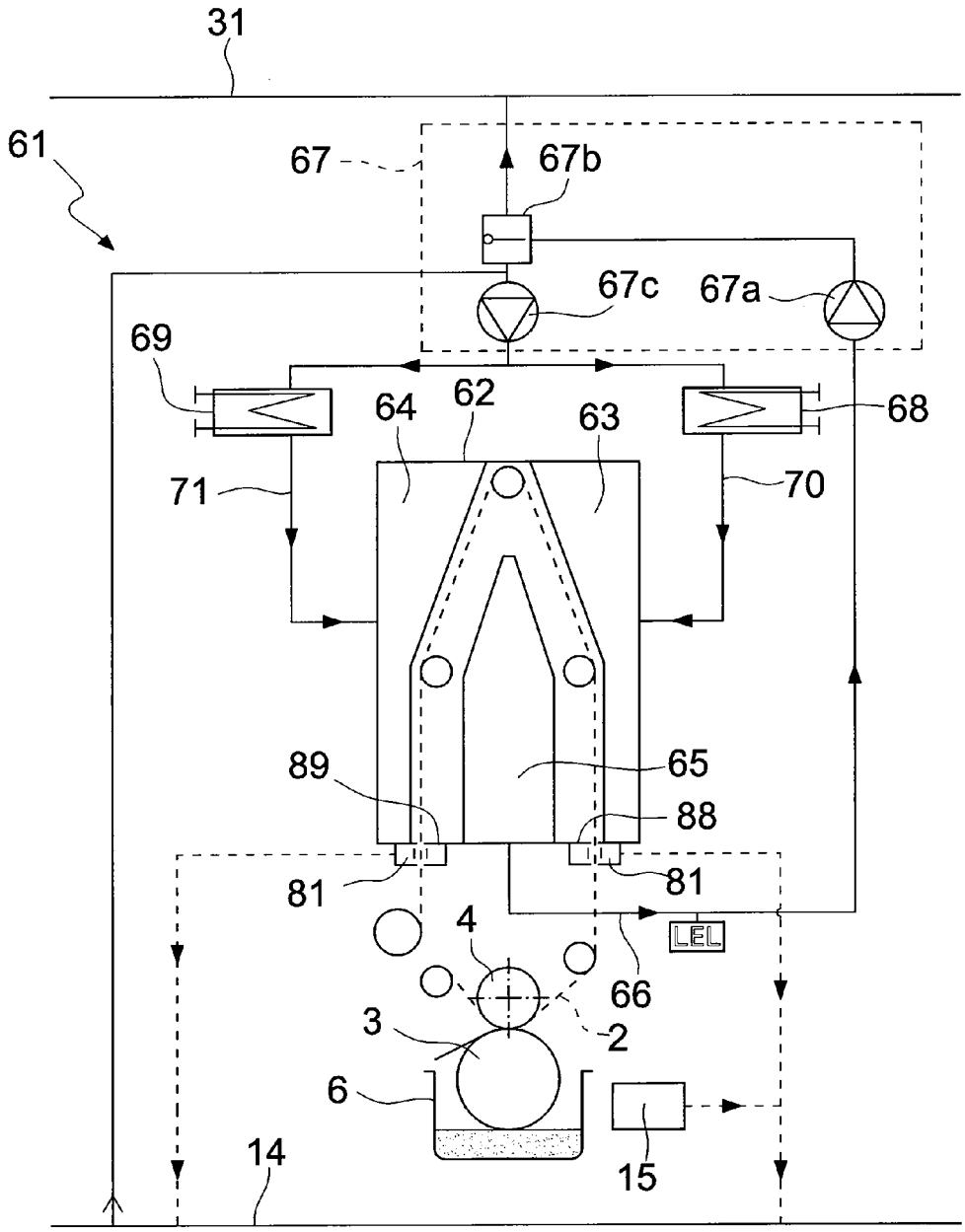

In FIG. 1*c* a printing unit 61 according to a third embodiment of the invention is shown. The printing unit comprises a double oven 62 with two drying air supply chambers 63 and 64 and a common drying air exhaust chamber 65, from which a drying air exhaust duct 66 provides a connection to a recirculation system 67 similar to those indicated with 57 and 58 in FIG. 1*b*, i.e. comprising an exhaust fan 67*a*, a recirculation device 67*b* and a drying air supply fan 67*c*. The recirculated air to which the air coming from the common recirculation duct 14 is added is blown by a single drying air supply fan 67*c* into two different heat exchangers 68 and 69 and, via respective drying air ducts 70, 71, to the drying air supply chambers 63 and 64. All the other features of the printing unit 61 remain the same of the printing unit 40 shown in FIG. 1*b*. In particular, false air suppression devices 81 are arranged in front of passages comprising the inlet 88 and the outlet 89 of the drying oven 62 and are maintained in a depressurized condition by means of respective ducts connected to the common recirculation duct 14, so as to prevent false air from entering the drying chambers of the oven 62.

Figure 2:
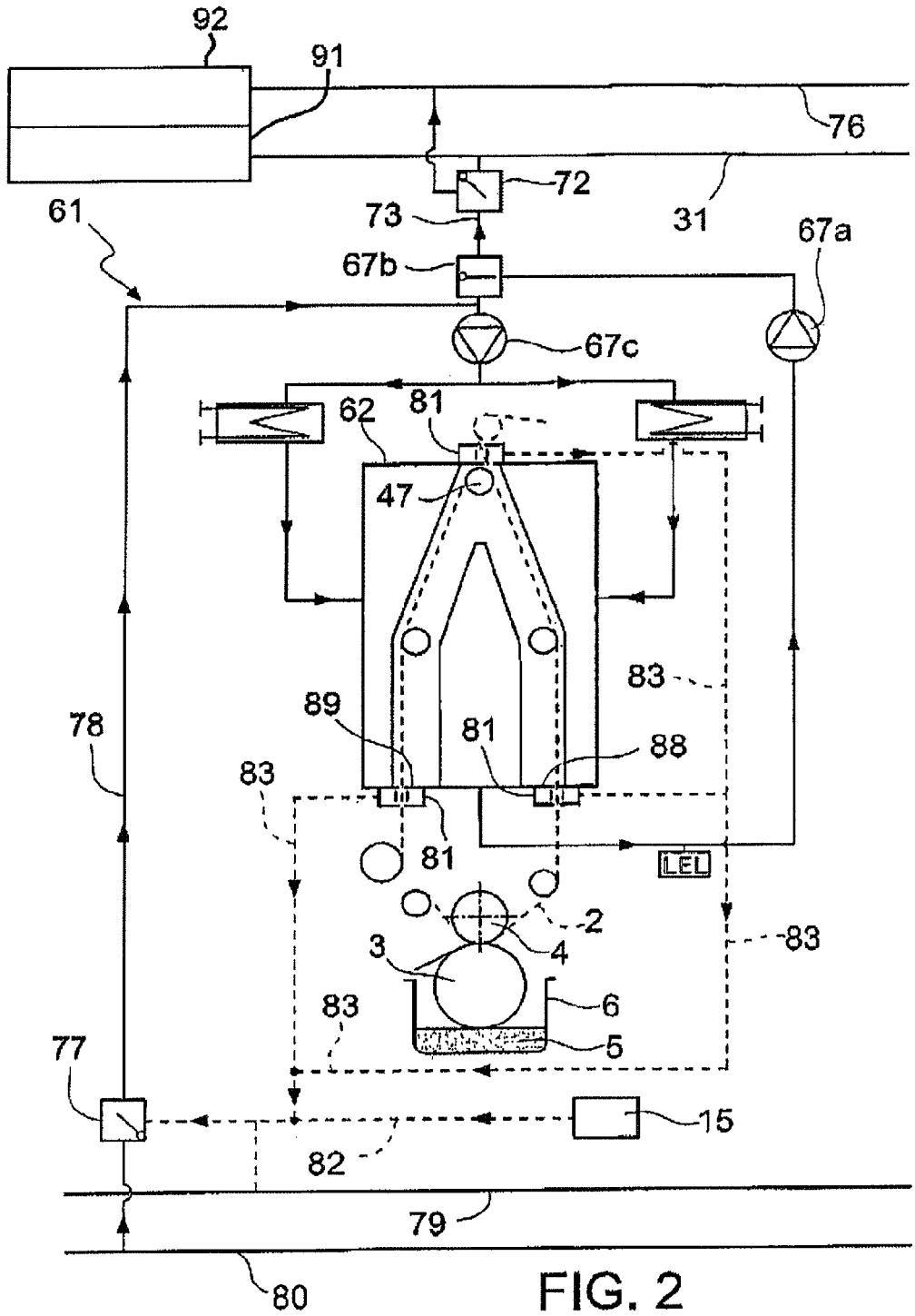
FIG. 2 shows a double oven printing unit with a common oven outlet chamber and with fresh air and exhausted air bypass.

According to FIG. 2, further optional features are applied to the printing unit 61, but they could be obviously applied to printing units 1 and/or 40, as the person skilled in the art can understand. In particular, a first bypass device 72 is added to the exhaust channel 73 for the air exiting the recirculation device 67*b*. The first bypass device 72 is a switch which is adapted to decide, via suitable control and sensors, whether sending the drying air exhausted from the oven to a main exhaust duct 31 for solvent recovery (via recovery unit 91) or to send it in a separated exhaust duct 76 for solvent burning (via burning unit 92).

A second bypass device 77 can be also provided, in particular along an intake channel 78, and it is adapted to select whether air from a common recirculation duct 79 or from a separated fresh air inlet duct 80 is to be recirculated. The fresh air inlet duct 80 is connected to the outside of the factory where the printing unit is installed and is preferably shared by all of the printing units of the rotogravure machine.

In particular operational conditions, the second bypass device 77 allows to take fresh air only from the fresh air inlet duct 80 and not from the common recirculation duct 79, which may contain solvent, for instance in those cases where water-based inks are used.

Figure 3:
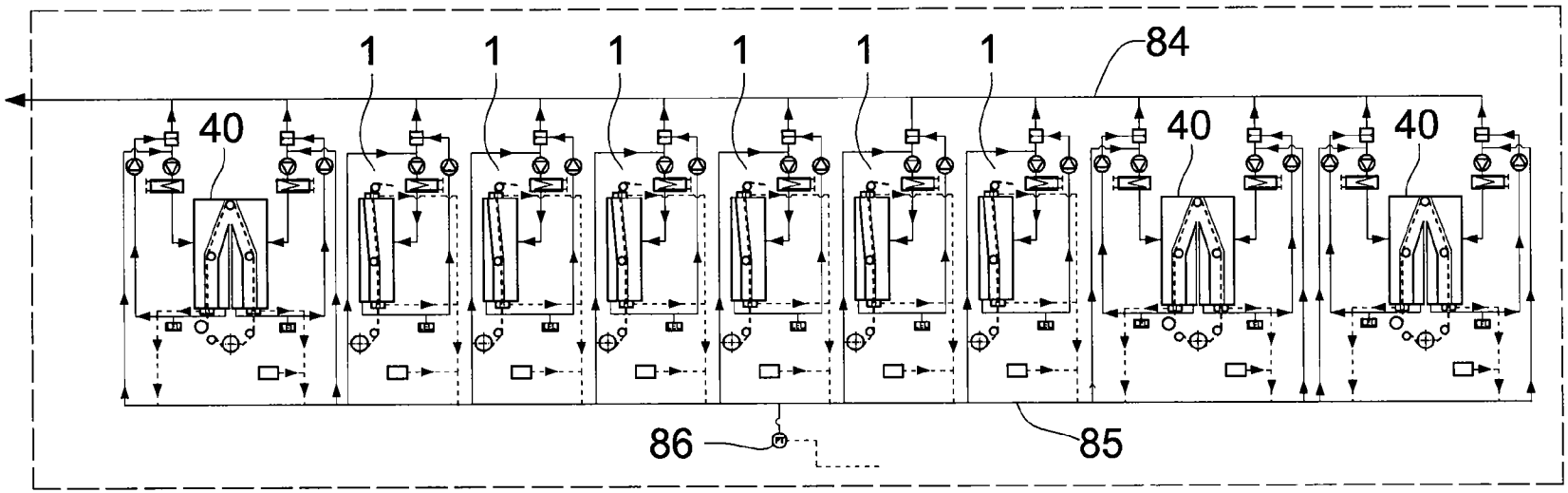
FIG. 3 shows a printing press layout single and double oven printing units without fresh air and exhausted air bypass.
Figure 4:
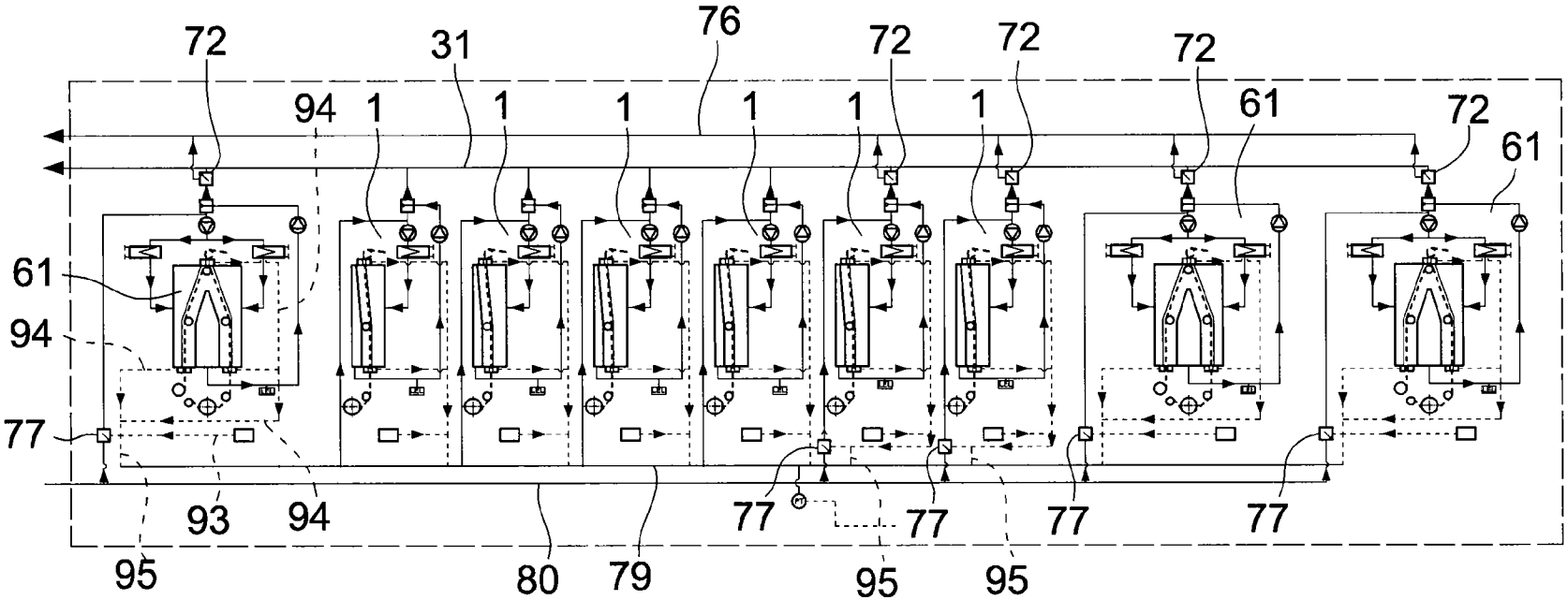
FIG. 4 shows a printing press layout with single and double oven printing units with a common oven outlet chamber and with fresh air and exhausted air bypass.

With reference to FIGS. 3 and 4, a rotogravure printing machine is shown, which comprises a plurality of printing units selected from any of the above printing units described herein above.

In FIG. 3 there are first printing units 1 with a single oven and second printing units 40 with double oven. As an alternative, third printing units 61 may be used instead of second printing units 40. The units are arranged in sequence, one adjacent to the other, so that the printed support 2 passes from one unit to the adjacent one. All the units exhaust the oven's air in a common exhaust duct 84 and take fresh air from a common recirculation duct 85, to which all of the false air suppression devices are connected.

Advantageously, a pressure transmitter 86 is connected to the common recirculation duct 85 for measuring the pressure inside such duct and taking more air from the ambient if the pressure is below a certain threshold.

In FIG. 4 printing units 1 with single oven and printing units 61 with double oven are shown, in which the first and the second bypass devices described herein above are present.

Printing units 40 according to the second embodiment of the invention may be obviously used in place of or in addition to printing units 61, if needed.

In particular, some printing units comprise the first bypass device 72 in order to be able to send the exhaust air in the main exhaust duct 31 or in a separated exhaust duct 76. Instead, the printing units provided with the second bypass device 77 can select whether to intake fresh air from a separated fresh air duct 80 or from the common recirculation duct 79, to which floor sweep air channels 93 and false air channels 94 are connected.

As it is apparent to a person skilled in the art, further features different from those described above can be provided, which are independent of the particular embodiment of this installation, without altering the interchangeability of the features of the instant invention.

It has been shown that the invention achieves the intended aims and objects. In particular, the presence of false air suppression devices which are maintained at a negative pressure permits to avoid that air with low concentration of solvent such as false air comes into the oven and also reduces the flow of air inside the printing press. In this way all the printing units can work with a highly reduced flow of air with higher solvent concentration, which then arrives also to the emission treatment system. An important consequence is simplification and reduction of the costs of exhaust air treatment installation, because the average concentration of solvent in the exhausted air is higher than in prior art machines.

Moreover, thanks to the common recirculation duct connected to all of the false air suppression devices, only those printing units that need air for the respective oven will take the false air from the common recirculation duct, improving the distribution of air between all the printing units.

Although the assembly according to the invention has been conceived in particular for rotogravure system, it can nonetheless also be used for other kinds of application which need the same requirements and specifications.

The assembly thus conceived is susceptible of numerous modifications and variations, all of which are within the scope of the appended claims. All the details may further be replaced with other technically equivalent elements.

The invention claimed is:

1. Drying equipment for printing machines comprising:

an oven configured and operable to dry solvent on a printed support travelling through said oven, said oven having passages through which false air can enter said oven from the outside;

a drying air supply fan and a heat exchanger, for supplying heated air to said oven, a measuring device for measuring solvent concentration inside said oven, a recirculation device connected to said oven through a drying air exhaust duct, said recirculation device being configured and operable to either supply drying air exhausted from said oven to said drying air supply fan and said heat exchanger or to exhaust such drying air exhausted from said oven, based on whether said solvent concentration is higher or lower than a predefined threshold, respectively, at least one false air suppression device which covers at least one of said oven passages and which is configured and operable to be maintained at a pressure lower than air pressure inside said oven preventing false air from entering said oven through said at least one passage;

a common recirculation duct to which said false air suppression device is connected; and a recirculated air duct connecting said common recirculation duct to said oven and configured and operable for supplying drying air to said oven.

2. The drying equipment of claim 1, wherein said oven includes an inlet followed by an outlet for said printed support entering, travelling through and exiting said oven;

said at least one false air suppression device comprises a first false air suppression device configured and arranged to cover said inlet of said oven, and a second false air suppression device configured and arranged to cover said outlet of said oven, said printed support being configured and arranged to travel through said oven through said inlet and then through said outlet.

3. The drying equipment of claim 2, wherein said at least one false air suppression device comprises at least one through channel through which said web travels and a false air exhaust duct connecting said channel to said common recirculation duct.

4. The drying equipment according to claim 1, further comprising:

at least one of a main exhaust duct and a separated exhaust duct;

a first bypass device connected to said recirculation device for exhausting said drying air exhausted from said oven to either said main exhaust duct or to said separated exhaust duct; and an emission treatment installation to which said at least one of said main and said separated exhaust ducts is connected.

5. The drying equipment according to claim 4, further comprising a second bypass device connected to said common recirculation duct, to said recirculation device and to a fresh air common duct, said second bypass device being configured to supply air from either said common recirculation duct or from said fresh air common duct to said recirculation device selectively based on a solvent used on said printed support.

6. A printing machine comprising a plurality of printing units, wherein each said printing unit comprises drying equipment said drying equipment comprising:

an oven configured and operable to dry solvent on a printed support travelling through said oven, said oven having passages through which false air can enter said oven from the outside;

a drying air supply fan and a heat exchanger, for supplying heated air to said oven, a measuring device for measuring solvent concentration inside said oven, a recirculation device connected to said oven through a drying air exhaust duct, said recirculation device being configured and operable to either supply drying air exhausted from said oven to said drying air supply fan and said heat exchanger or to exhaust such drying air exhausted from said oven, based on whether said solvent concentration is higher or lower than a predefined threshold, respectively, at least one false air suppression device which covers at least one of said oven passages and which is configured and operable to be maintained at a pressure lower than air pressure inside said oven preventing false air from entering said oven through said at least one passage;

a common recirculation duct to which said false air suppression device is connected; and a recirculated air duct connecting said common recirculation duct to said oven and configured and operable for supplying drying air to said oven;

wherein said common recirculation duct is connected to all of said false air suppression devices installed in all of said printing units.

7. The printing machine according to claim 6, wherein said common recirculation duct comprises a pressure transmitter configured to measure pressure inside said common recirculation duct and configured and operable to draw air from the ambient if such measured pressure is below a predefined threshold.

* * * * *